US006550748B2

(12) United States Patent
Stanek et al.

(10) Patent No.: US 6,550,748 B2
(45) Date of Patent: Apr. 22, 2003

(54) DRY OUT MECHANISM FOR HUMIDIFIER

(75) Inventors: Terrence L. Stanek, St. Charles, MO (US); Steven L. Rhea, St. Peters, MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/866,829

(22) Filed: May 29, 2001

(65) Prior Publication Data

US 2002/0180071 A1 Dec. 5, 2002

(51) Int. Cl.[7] ..... B01F 3/04

(52) U.S. Cl. ..... 261/26; 261/72.1; 261/96; 261/105; 261/DIG. 46

(58) Field of Search ..... 261/26, 30, 72.1, 261/9.6, 102, 105, DIG. 46

(56) References Cited

U.S. PATENT DOCUMENTS 3,722,838 A * 3/1973 Swimmer et al. ..... 261/72.1
5,108,663 A * 4/1992 Chiu ..... 261/26
5,143,656 A * 9/1992 Marino et al. ..... 261/26
5,945,038 A * 8/1999 Anderson ..... 261/105
6,427,984 B1 * 8/2002 Mulvaney et al. ..... 261/72.1

* cited by examiner

*Primary Examiner*—C. Scott Bushey
(74) *Attorney, Agent, or Firm*—Howrey Simon Arnold & White

(57) ABSTRACT

A dry out mechanism for controlling a humidifier is disclosed. The mechanism includes a float and a switch. The float contacts the switch when the float is within an operating range. The movement of the float can be manually changed between settings to achieve normal operation or dry out operation of the humidifier. In the normal operation, the float activates the switch based on the fluid level within the humidifer's reservoir. In the dry out setting, the float activates the switch independent from the level of fluid within the reservoir so that the humidifier depletes the reservoir and components of fluid.

6 Claims, 5 Drawing Sheets

DRY OUT MECHANISM FOR HUMIDIFIER

BACKGROUND OF THE INVENTION

1. Field of the Invention

The present invention is related to the field of humidifiers. Specifically, the present invention is related to humidifiers with a float and switch mechanism that controls the operation of the humidifier.

2. Description of the Prior Art

Humidifiers are principally used during winter to add moisture to room air. As is well known, the capacity of air to carry water vapor is reduced as temperature decreases, and the use of electric or gas heating also tends to lower the moisture of room air. Humidification of room air protects the human respiratory system against viruses and air pollutants, ameliorates some symptoms of the common cold, and prevents atopic dermatitis. Humidification of room air also can reduce static electricity and protect furniture and upholstery.

A wide variety of humidifiers have been constructed. A conventional float and switch mechanism in the reservoir provides automatic control of the humidifier when the water level drops below a preconceived depth. Thus, the humidifier will not run when it is depleted of water. Unfortunately, some amount of water remains in the reservoir and the internal parts of the humidifier after shut off. Retention of water in the reservoir and apparatus promotes the growth of mold and bacteria if the humidifier is not in used for an extended period.

The end of the winter season or long periods not requiring humidification are some occasions when complete dry out of the humidifier may be desirable. On such occasions, it is advantageous to allow the humidifier to continue to run, depleting the unit of water and drying out the internal parts. Drying the reservoir and components extends the life of the humidifier and keeps the unit clean for future use.

Therefore, the present invention proposes a solution to the problem of retaining water in humidifiers at the end of their required use.

SUMMARY OF THE INVENTION

In view of the foregoing and other considerations, the present invention relates to a dry out mechanism for a humidifier.

In accordance with one aspect of the present invention, a humidifier includes a reservoir adapted to contain fluid. A wick is situated to be wetted by fluid contained in the reservoir. A fan is operable to move air through the wick to humidify the air. A switch for controlling operation of the fan is also provided. A float is movable between a first position to activate the switch and a second position to deactivate the switch. A float holder connects the float to the humidifier. The float holder has a first setting in which the float is movable between the first and second positions in response to the level of fluid contained in the reservoir. The float holder also has a second setting in which the float is fixed in the first position independent of the level of fluid contained in the reservoir.

In accordance with another aspect of the present invention, there is provided a method for drying out a humidifier. The humidifier includes a reservoir for holding a fluid such as water. There is also a wick situated relative to the reservoir to be wetted by the fluid from the reservoir. There is further provided a fan for moving air through the wick to be moistened. The method includes allowing a float to have a first range of movement, wherein the float activates and deactivates the fan in response to the amount of fluid contained in the reservoir. The method also includes allowing the float to have a second range of movement, wherein the float activates the fan independent of the amount of fluid contained in the reservoir.

BRIEF DESCRIPTION OF THE DRAWINGS

The foregoing, a preferred embodiment and other aspects of the present invention will be best understood with reference to a detailed description of specific embodiments of the invention, which follows, when read in conjunction with the accompanying drawings, in which.

Figure 1:
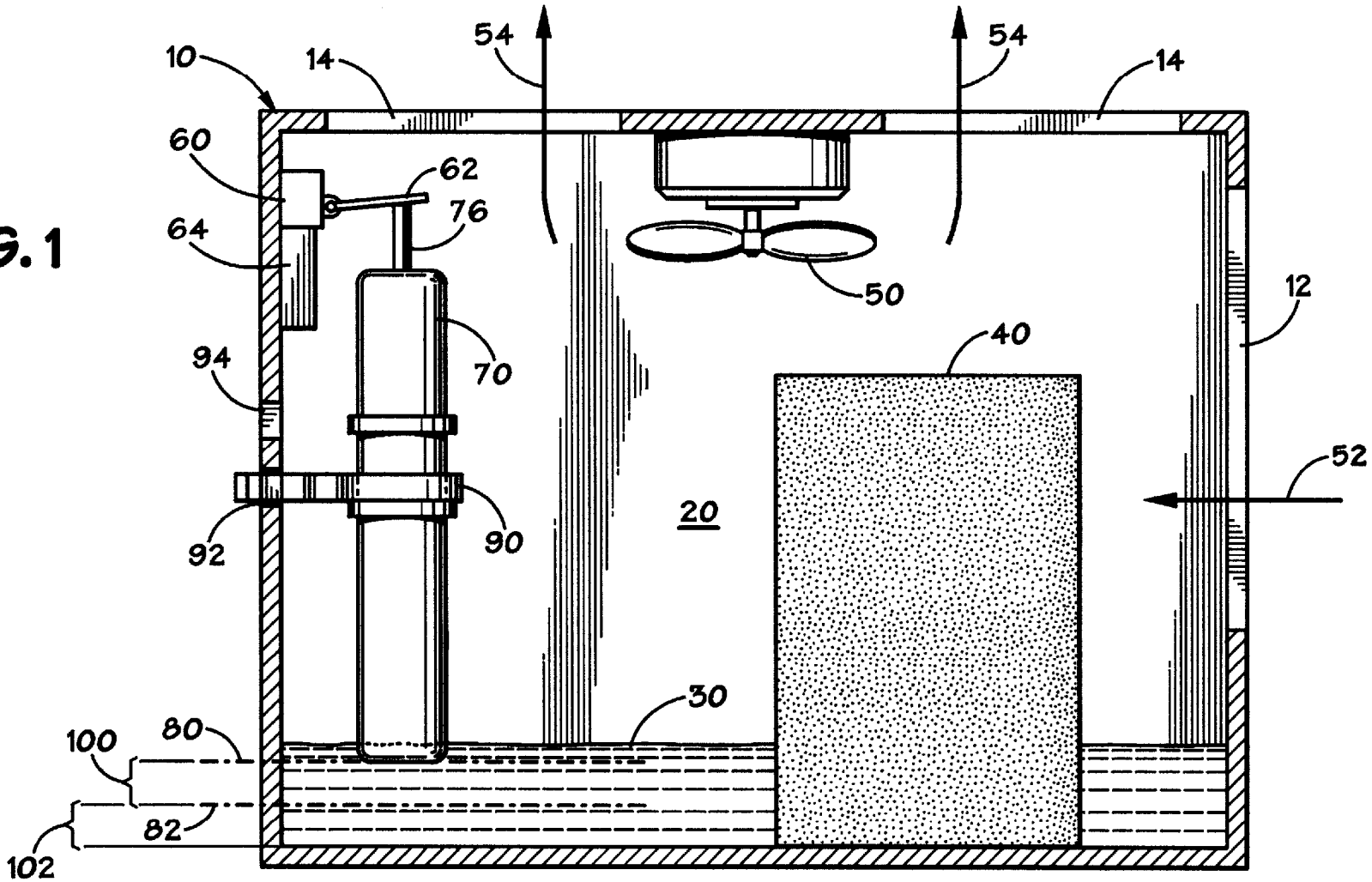
FIG. 1 illustrates an exemplary humidifier according to the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modification, equivalents and alternatives falling within the scope of the invention as defined by the appended claims.

DETAILED DESCRIPTION OF THE INVENTION

In the disclosure that follows and in the interest of clarity, not all the features for actual implementation are described. In the actual implementation, numerous decisions must be made to achieve the specific goals. Such a development effort might be complex and time-consuming, but would nevertheless be a routine undertaking for those of ordinary skill in the relevant fields.

FIG. 1 conceptually illustrates an exemplary humidifier. The illustrated humidifier represents a simplification of a humidifier with a dry out mechanism installed in accordance with the present invention. It will be clear to one skilled in the art that humidifiers with alternative modes of action may be constructed using the embodiments described herein, and are thus within the scope of the present invention. Additionally, those experienced in the art of humidifiers will recognize the useful application of the present embodiment in a variety of humidifiers or other devices using a float and switch mechanism.

The humidifier has a cabinet 10 that defines a chamber or reservoir 20. The reservoir 20 is adapted to contain a fluid 30, which in the case of a humidifier is typically water.

Within the reservoir 20, a wick 40 is wetted by the fluid 30 contained. A fan 50 moves air into the chamber 20 though an inlet 12 in the cabinet 10. The air 52 from the environment passes through the wick 40 laden with fluid. Fluid vapor is then transferred to the air. The humidified air 54 is transported out of the cabinet 10 through outlets 14.

A switch 60 controls operation of the fan 50. The switch 60 is activated by a float 70. The float 70 is buoyant in the fluid 30 and can contact the switch 60. The contact between the float 70 and switch 60 may involve a guide rod 76 on the float 70 that moves a lever mechanism 62 to activate the switch 60. Those skilled in the art having the benefit of this disclosure will readily conceive of various mechanisms to create the contact of the float with the switch.

The float 70 is movable between a first position 80 to activate the switch 60 and a second position 82 to deactivate the switch 60. When the level of the water is sufficient in the reservoir 20, the buoyancy of the float 70 forces the float 70 into contact with the switch 60. The switch 60 activates the humidifier by completing control circuitry for a control unit 64. The switch 60 constitutes a part of the control unit 64 of the humidifier, which may include a power supply, additional switches, timers and other control means.

A float holder 90 connects the float 70 to the humidifier. The float holder 90 has a first setting 92. When the float holder 90 is attached to the first setting 92, the float 70 is movable between the first position 80 and second position 82 in response to the level of fluid 30 contained in the reservoir 20. In contrast, when the float holder 90 is attached to the second setting 94, the float is fixed in the first position 80 independent of the level of fluid 30 contained in the reservoir 20.

The first and second settings 92, 94 may be a slot or hole in the cabinet or reservoir wall 10. The float holder 90 is inserted in the slot and projects outside the cabinet 10. A user outside the cabinet 10 of the humidifier can manually move the float holder 90 to another setting and change the operating parameters of the float 70 and switch mechanism 60. The slot or hole in the chamber wall 10 will not interfere with the fluid 30 in the reservoir 20, as it is not intended to be filled to that level.

The first position 80 of the float 70 defines the position in the reservoir where the float activates the switch. The second position 82 defines the position in the reservoir where the float does not activate the switch. The float 70 will typically move within a range of positions in the reservoir 20. For this reason, an activation range 100 exists between the first 80 and second 82 positions of the float 70, where the float 70 activates the switch 60. Also, a deactivation range 102 exists below the second position 82 of the float 70, where the float 70 does not activate the switch 60.

The first setting 92 defines a "normal" setting. In the normal setting, the float 70 is movable within the activation range 100 and the deactivation range 102. The second setting 94 defines a "dry out" setting. In the dry out setting, the float 70 is movable only within the activation range 100.

Figure 2:
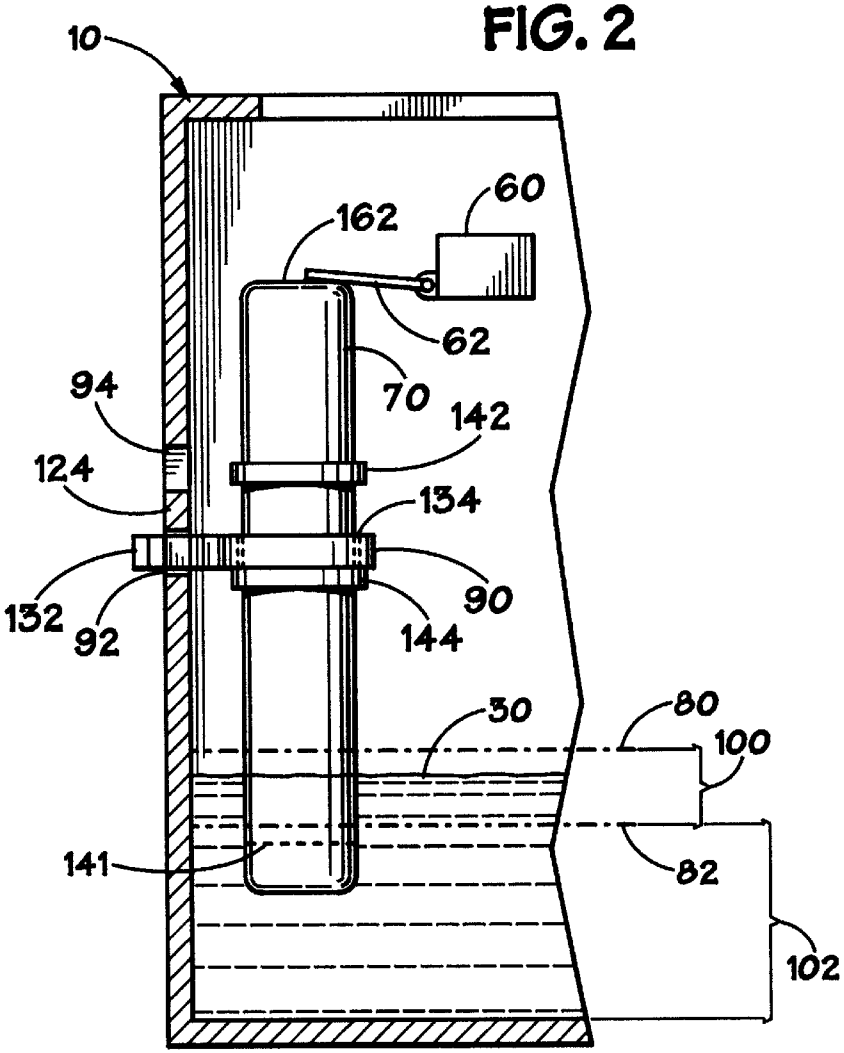
FIG. 2 illustrates an embodiment of the present invention activated in a normal setting of operation.

FIG. 2 shows a dry out mechanism in accordance with aspects of the present invention. In the present discussion and foregoing embodiments, aspects of the humidifier are isolated for simplification in description. A vertical member 10 of a reservoir or chamber wall is shown. As discussed in conjunction with FIG. 1, the vertical member 10 has two settings, a dry out setting 94 and a normal setting 92. A setting differentiator 124 may separate the two settings. The settings 92, 94 may comprise, for example, holes or slots in the material of the vertical member 10.

An end 91 of the float holder 90 is received by the normal setting 92. The float holder 90 has an opening 134 substantial enough to allow the float 70 to move vertically therein. The float 70, for example, may have an oblong shape oriented vertically within the float holder 90. An upper retainer 142 and a lower retainer 144 limit vertical movement of the float 70 within the float holder opening 134. The lower retainer 144 limits the float 70 from moving upward due to excessive buoyancy forces of a higher fluid level. In contrast, the upper retainer 142 limits the float from moving downward due to gravitational forces when the fluid is at a lower level.

The float 70 is buoyant in a fluid 30, which in the case of a humidifier for room air is typically water. The float 70 may comprise a sealed hollow shell or a solid foam structure that both quite readily float in water. On the float 70, a minimum buoyancy level 141 is illustrated. The minimum buoyancy level 141 visually depicts the water level on the float required for the float to displace the necessary volume of water to remain buoyant.

For those skilled in the related art, it will be appreciated that the float is relatively light and has a large surface area so that the minimum buoyancy level 141 is near the bottom of the float. It will also be appreciated that frictional forces created between the float holder 90 and the float 70 are very slight. As a result, the float must displace very little water in order for it to remain buoyant. FIG. 2, of course, shows a simplification of these details.

A switch 60 is situated at a predetermined level within the reservoir. The float 70 activates a lever 62 of the switch 60 at a contact point 162. The switch 60 provides an automatic means of controlling the humidifier based on a water level in the reservoir. Activation of the switch 60 at the contact 162 is determined by the general geometry involved in the mechanism such as the location of the switch, the dimensions of the float and the level of the water. In particular, activation is determined by the float holder 90 in the settings 92 or 94. In order for activation of the switch 60 to be maintained, the minimum buoyancy level 141 must be kept within the activation range 100.

Figure 3:
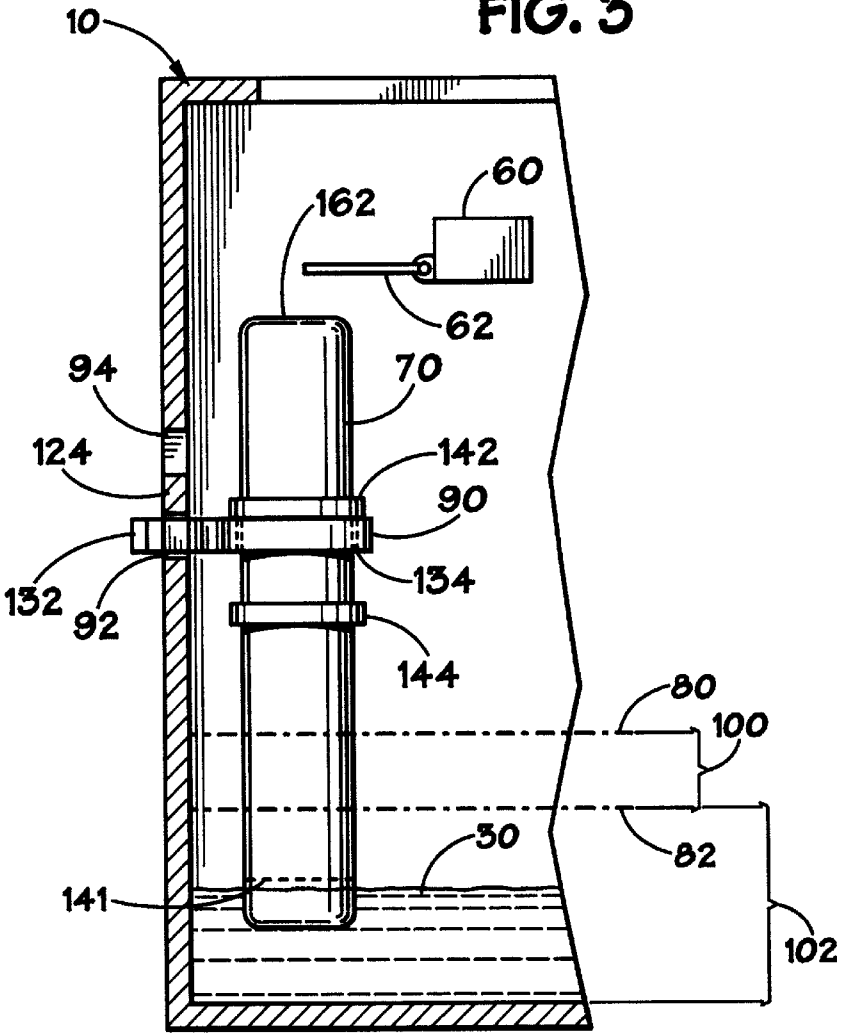
FIG. 3 illustrates the embodiment of the present invention deactivated in the normal setting of operation.

FIG. 3 shows the result of continued operation of the humidifier in the normal setting 92 as presented in FIG. 2 above. The contact 162 between the float 70 and switch 160 is no longer made. In other words, the water level has diminished enough to bring the minimum buoyancy level 141 below the activation range 100 into the deactivation range 102. As stated previously, the water 30 remaining in the reservoir can be undesirable during certain periods of the season or under certain operating conditions.

Figure 4:
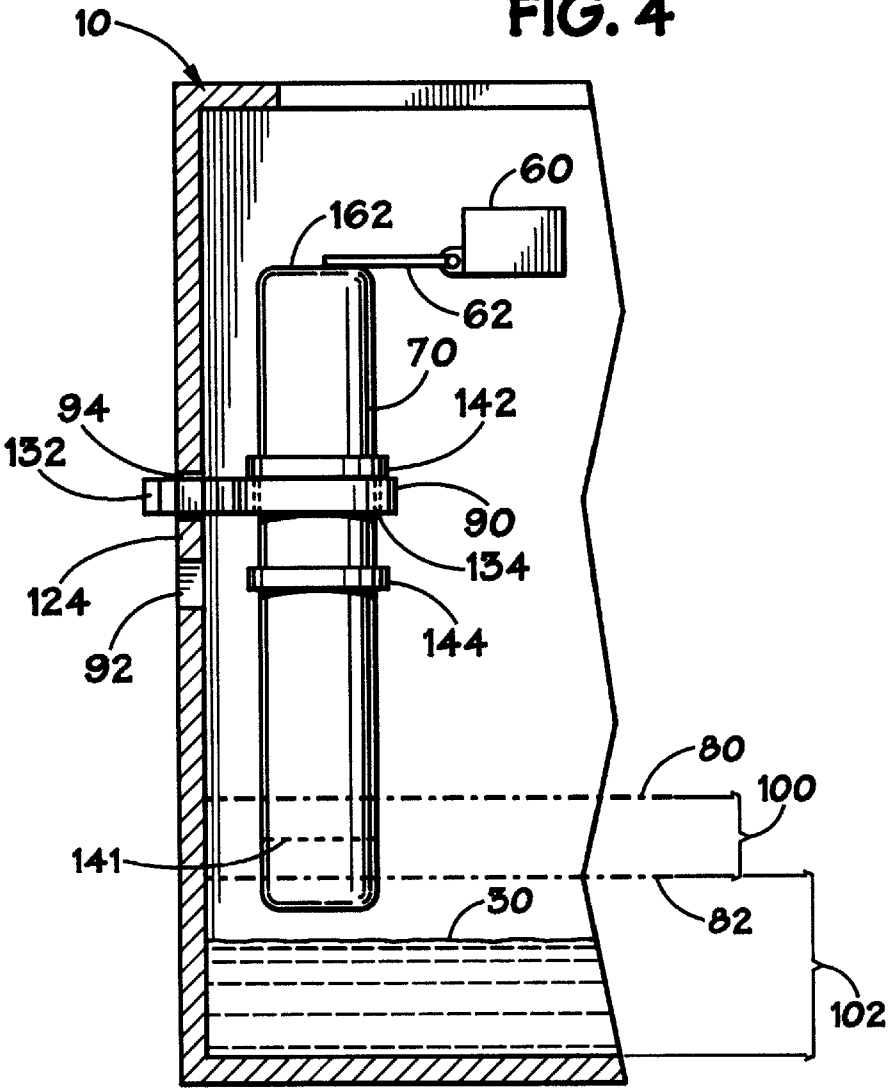
FIG. 4 illustrates the embodiment of the present invention activated in a dry out setting of operation.

To overcome the undesirable retention of water in the humidifier, the dry out setting 94 for the humidifier is provided. FIG. 4 depicts the float 70 held within the ring of the float holder 90. As before, both the float 70 and the float holder 90 are attached to the reservoir wall 10. In this instance, the float holder 90 is attached to the dry out setting 94, which is located vertically above the normal setting 92. In contrast to the normal setting 92, activation of the switch 60 is maintained even though the float 70 loses buoyancy in the water 30. The minimum buoyancy level 141 is kept within the activation range 100 even though there are no buoyancy forces pushing the float 70 upwards. The retainer 142 resting against the float holder maintains the float 70 in contact with the switch 60.

In use of the present arrangement, the switch 60 remains activated, and the humidifier continues to operate. As a result, the water 30 continues to be depleted, and the humidifier continues to operate in a dry out mode. Thus, the reservoir and components of the humidifier dry out with operation. As noted, this can be advantageous under certain conditions or during certain periods.

Figure 5:
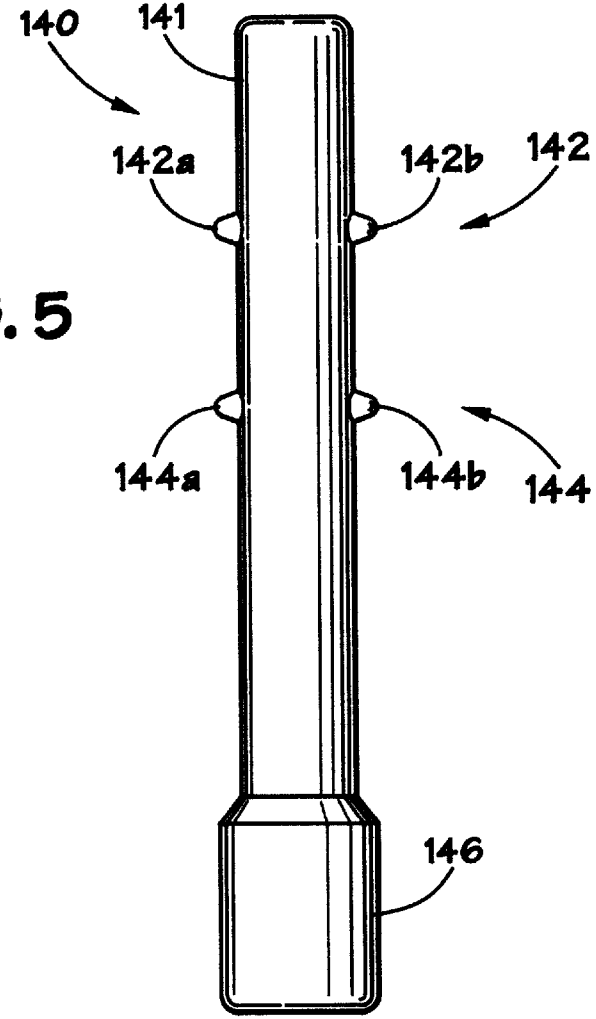
FIG. 5 illustrates a preferred embodiment of a float according to the present invention.

FIG. 5 illustrates an exemplary embodiment of a float 140. The float 140 defines an elongated, closes cylinder 141. Positioned on either side of the cylinder 141, a first pair of knobs 142*a* and 142*b* project from the surface of the cylinder 141 and define the upper retainer 142 of the float 140. A second pair of knobs 144*a* and 144*b* are also position on either side of the surface of the cylinder 141. The second pair of knobs 144*a–b* are positioned lower on the cylinder 141 and define the lower retainer 144 of the float 140. At the lowest end of the float 140, the cylinder 141 increases in diameter to form a buoyant member 146, which situates in the water of the humidifier.

Figure 6:
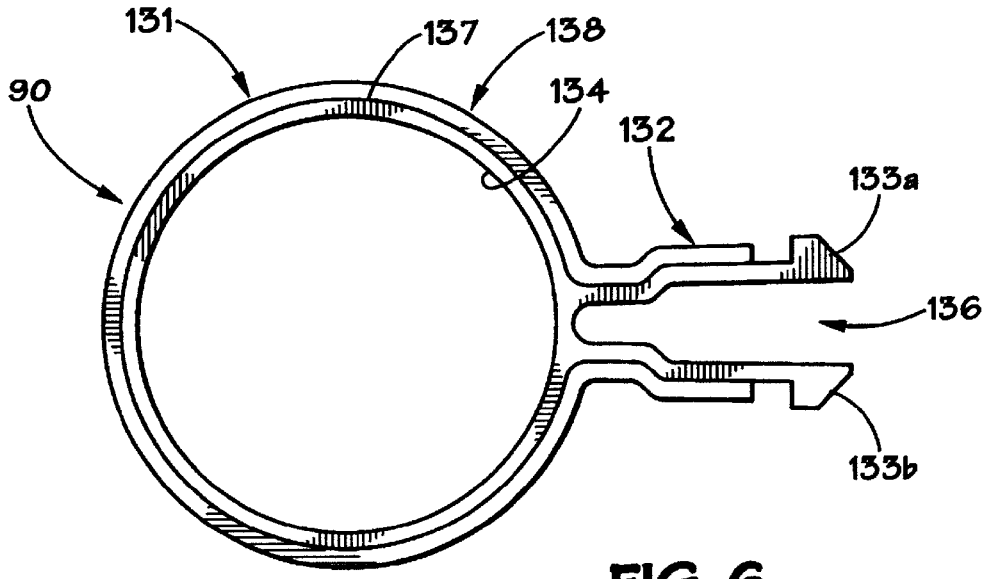
FIG. 6 illustrates a preferred embodiment of a float holder according to the present invention.

FIG. 6 illustrates an embodiment of the float holder 90 in an enlarged view. The float holder 90 includes a ring-shaped retainer 131 and a tab portion 132. The ring-shaped shaped retainer 131 defines a round opening 134 for holding the cylindrical float such as that illustrated in FIG. 5 above. The tab portion 132 connects to the ring-shaped retainer 131 and includes bifurcate snaps 133*a* and 133*b*. The bifurcate snaps 133*a–b* are a hooked-shape and have a horizontal orientation in the present embodiment. In other embodiments, the bifurcate snaps 133*a–b* may have a vertical orientation or may be further spaced apart from one another. The snaps 133*a–b* insert into slots (not shown) in the reservoir wall as described above. At their distal ends 136, the snaps 133*a–b* are further spaced apart to pinch-fit into the slots. The ring-shaped retainer 131 and the tab portion 132 are formed from a continuous piece of material 137 that may have rim 138 to provide sturdiness.

Figure 7:
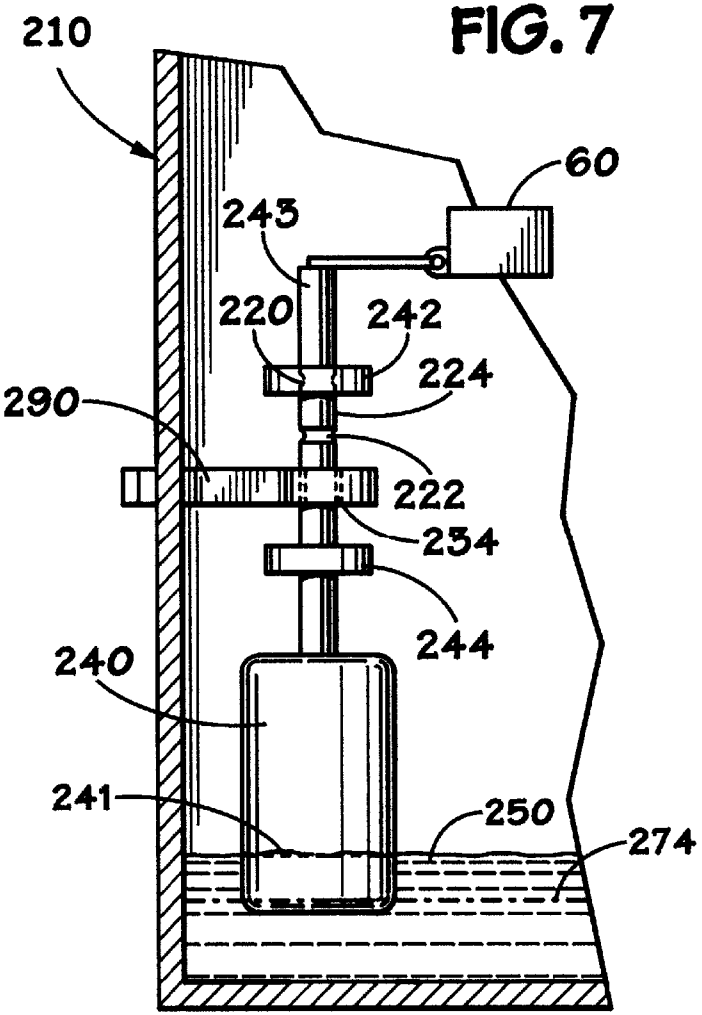
FIG. 7 illustrates another embodiment of the present invention.

FIG. 7 shows another embodiment of a dry out mechanism according to the present invention. The reservoir 10 has a float holder 290 attached. The float holder 290 has an opening 234 to allow a float 240 to move vertically therein. The float 240 is buoyant in water 250 of the reservoir. A minimum buoyancy level 241 is shown on the float 240 and represents a minimum amount of water volume that the float 240 must displace in order to remain buoyant.

The float 240 also includes a guide stem 243 that extends through the opening 234 and contacts a switch 60. The guide stem 243 has an upper retainer 242 and a lower retainer 244. The lower retainer 244 is not essential in the present embodiment, but is useful in limiting the force on the switch 460 from the float 240 when sufficiently immersed in the water 250.

With the upper retainer 242 in the normal setting 220, contact with the switch 60 is lost when the minimum buoyancy level 241 falls below the activation threshold 274 in the reservoir 210. In other words, when the float 240 loses buoyancy in the water 250, the float 240 will drop to a level within the reservoir 210 to where contact with the switch 60 is not maintained. The upper retainer 242 is movable to a dry out setting 222 by passing the retainer over a setting differentiator 224. In the dry out setting 222, the float 240 remains in contact with the switch 60 although the float 240 is no longer buoyant in the water 250.

Figure 8:
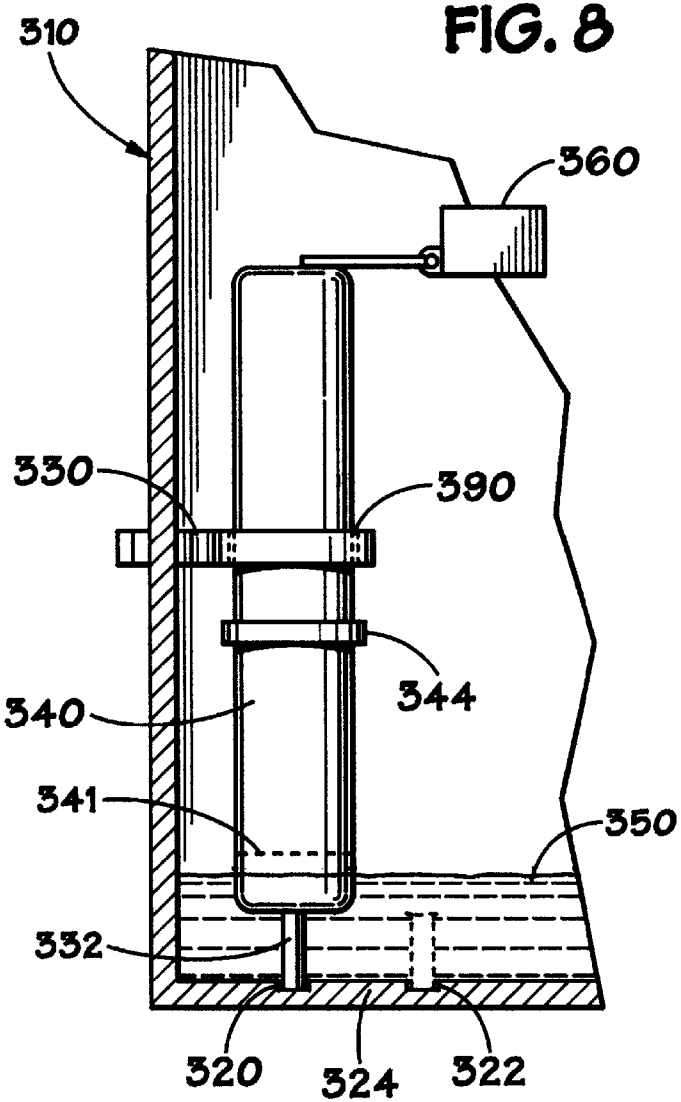
FIG. 8 illustrates an additional embodiment of the present invention.

FIG. 8 depicts another embodiment of the dry out mechanism according to the present invention. The humidifier has a reservoir 310 with a float holder 390 attached. The float holder 330 has an opening 390 to allow a float 340 to move vertically therein. The float 340 is buoyant in the water 350 of the reservoir. A minimum buoyancy level 341 is shown on the float 340. In the present embodiment, the float 340 has only a lower retainer 344. An indicator 332 is installed in a dry out setting 320 in the reservoir. The indicator 332 is an independent component from the float 340 and float holder 330. The indicator 332 may be moved between a dry out setting 320 and a normal setting 322, which define slots in the bottom of the reservoir 310.

When the indicator 332 is installed in the dry out setting 320, the indicator 332 limits the vertical movement of the float 340 within the float holder 330. The float 340 is kept in contact with the switch 360, and the humidifier remains activated while the float 340 loses buoyancy in the water 350. In another embodiment, the indicator 332 may be pivotally disposed in the bottom of the reservoir 310. In the dry out setting, the indicator 332 may extend into the reservoir 310 and limit the downward movement of the float 340. In the normal setting, the indicator 332 may be pivoted flush with the bottom of the reservoir 310 to allow the float 340 to reach a full downward position in the reservoir 310.

In yet another embodiment, the indicator 332 may be a stem or flap (not shown) attached to the bottom of the float 340 by a hinge (not shown). When positioned in a normal setting, the stem may be placed flush with the bottom of the float 340 and allow the float 340 to attain a full downward position. When positioned in a dry out setting, the stem may extend towards the bottom of the reservoir 310 and limit the float 340 from moving downward as the water 350 is depleted.

Figure 9:
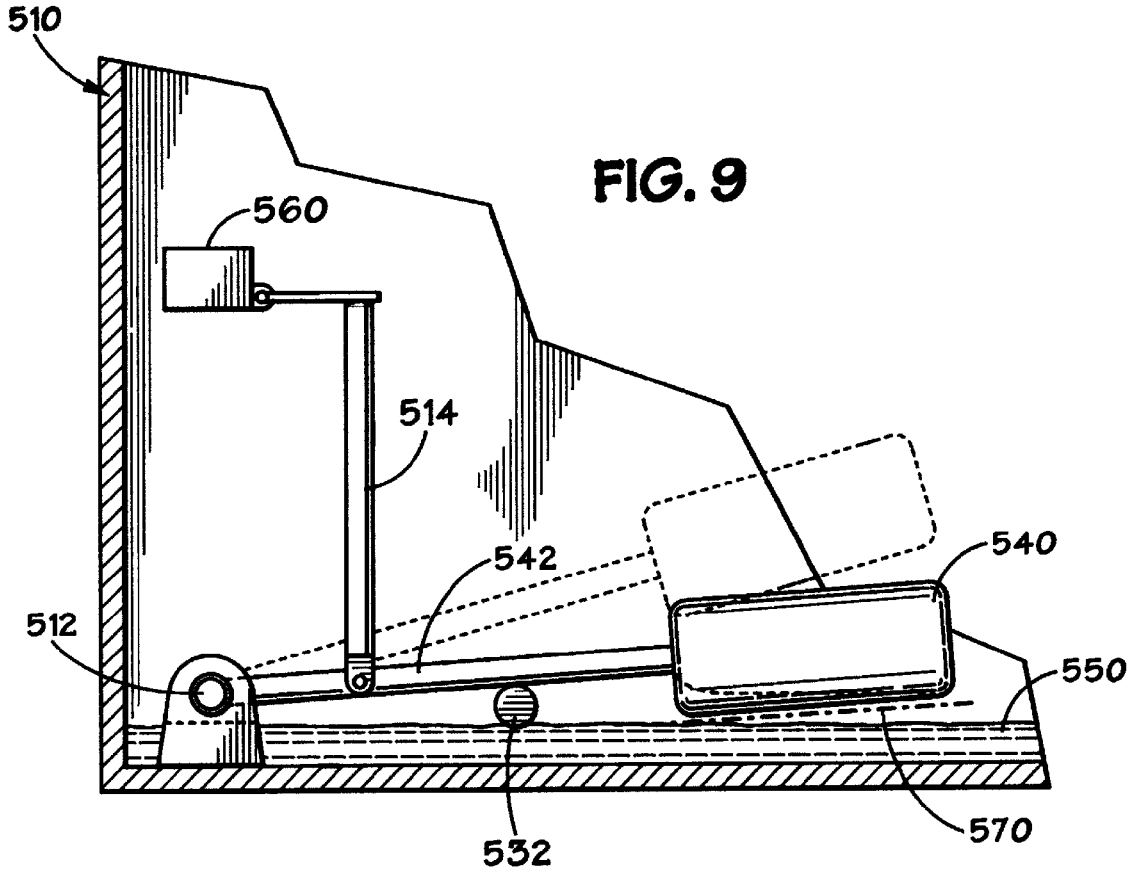
FIG. 9 illustrates yet another embodiment of the present invention.

FIG. 9 shows yet another embodiment in accordance with the present invention. Many humidifiers use a float attached for radial movement on a lever arm. The present embodiment shows a dry out mechanism in use in just such an arrangement. The humidifier has a reservoir 510 with a float holder 512 attached. The float 540 has a lever arm 542 hingedly attached to the float holder 512. The float 540 is buoyant in the water 550 of the reservoir.

A stem 514 is hingedly attached to the lever arm 542 of the float 540. The stem 514 engages the switch 560 of the humidifier when the float 540 is above an activation threshold 570. The indicator 532 is installed in the reservoir. In the dry out setting, the indicator 532 obstructs the path of the lever arm 542 and limits the movement of the float 540 within the reservoir 510. In particular, the indicator 532 keeps the float 540 from dropping to where the stem 514 loses contact with the switch 560. Again, the humidifier is enabled to operate despite the fact that the float 540 loses buoyancy in the water 550. In the present embodiment, the indicator 532 may include manually operated push button operation from the exterior of the reservoir 510.

The dry out mechanism according to the present invention offers a novel way to manually control the operation of a humidifier. The dry out mechanism has a normal setting and a dry out setting. When desirable, the setting for the humidifier can be manually changed from either inside or outside the humidifier. In the normal setting, the humidifier will cease operating when the fluid level falls below a predetermined level. In the dry out setting, the humidifier will continue to deplete itself of water and thus dry out the reservoir and internal parts. Also, various float holders and snaps have been depicted to illustrate a variety of possible arrangements for these items.

The normal and dry out settings with indicator can be located on the float holder, in the reservoir wall, on the reservoir bottom, or on the float itself. A number of possible embodiments have been described in order to show how applicable the present invention is to a variety of float and switch arrangements.

From the foregoing, it will now be appreciated that the dry out mechanism of the present invention has a novel construction and arrangement of features. While this invention has been described in terms of preferred embodiments, it will be apparent to those of skill in the art that variations or modifications may be applied to the present invention. Any such variations, modifications or the equivalents thereof are deemed to be within the scope of the present invention as described in the present disclosure and defined by the appended claims.

What is claimed is:

1. A humidifier, comprising:

a reservoir adapted to contain fluid;

a wick situated to be wetted by fluid contained in the reservoir;

a fan operable to move air through the wick;

a switch for controlling operation of the fan;

a float movable between a first position to activate the switch and a second position to deactivate the switch; and a float holder connecting the float to the humidifier, the float holder having a first setting in which the float is movable between the first and second positions in response to the level of fluid contained in the reservoir, and having a second setting in which the float is fixed in the first position independent of the level of fluid contained in the reservoir.

2. The humidifier of claim 1, wherein the first position of the float further comprises an activation range, wherein the float activates the switch; and the second position further comprises a deactivation range, wherein the float does not activate the switch.

3. The humidifier of claim 2, wherein the first setting further defines a normal setting, wherein the float is movable within the activation range and the deactivation range.

4. The humidifier of claim 3, wherein the second setting further defines a dry out setting, wherein the float is movable only within the activation range.

5. The humidifier of claim 4, wherein the humidifier further comprises:

a retainer on the float to limit movement of the float in relation to the float holder; and a slot in the humidifier slidably receiving the float holder, the slot having a first end defining the normal setting and a second end defining the dry out setting; the second end being situated vertically above the first end;

wherein the retainer on the float contacts the float holder when in the dry out setting and maintains the float in the activation range as the level of fluid diminishes in the reservoir.

6. The humidifier of claim 5, wherein the float holder is slidable between the dry out setting and the normal setting.

* * * * *